US006012789A

United States Patent [19]

Lai

[11] Patent Number: 6,012,789

[45] Date of Patent: Jan. 11, 2000

[54] MIRROR BASE OF A VANITY OR JEWEL CASE

[75] Inventor: Kuo-Tsun Lai, Taichung, Taiwan

[73] Assignee: Tong Tsun Woodenware Co., Ltd., Taichung, Taiwan

[21] Appl. No.: 08/985,352

[22] Filed: Dec. 4, 1997

[30] Foreign Application Priority Data

Oct. 8, 1997 [TW] Taiwan ..... 86217045

[51] Int. Cl.[7] ..... A47G 1/00

[52] U.S. Cl. ..... 312/225; 312/227; 312/300; 40/724; 40/723

[58] Field of Search ..... 312/224, 225, 312/226, 227, 234, 300, 321.5, 324, 223.5, 204, 349, 280; 40/724, 722, 723, 747, 781

[56] References Cited

U.S. PATENT DOCUMENTS

| | | | |
|---|---|---|---|
| 153,283 | 7/1874 | Shatto | 40/768 |
| 393,679 | 11/1888 | Wiederer | 312/225 X |
| 589,695 | 9/1897 | Carraine | 40/768 |
| 1,382,983 | 6/1921 | Kent | 312/227 X |
| 1,673,656 | 6/1928 | Willis et al. | 312/227 X |
| 1,790,836 | 2/1931 | Porter et al. | 312/227 X |
| 2,848,290 | 8/1958 | Doty | 312/227 X |
| 3,039,217 | 6/1962 | Stefanakis | 312/224 X |
| 4,412,708 | 11/1983 | Palka | 312/227 X |

*Primary Examiner*—Janet M. Wilkens
*Attorney, Agent, or Firm*—Browdy and Neimark

[57] ABSTRACT

A vanity or jewel case is provided with a mirror base, which is fastened pivotally at one side thereof with an upper edge of one side of a body of the vanity or jewel case. The mirror base is composed of a cover plate and two mirror doors. The cover plate is provided in one side thereof with a mirror, whereas the mirror doors are fastened pivotally with the cover plate and provided with a mirror opposite to the mirror of the cover plate. The mirror doors are provided with a picture slot for holding a picture, which is further secured by a press plate.

4 Claims, 5 Drawing Sheets

MIRROR BASE OF A VANITY OR JEWEL CASE

FIELD OF THE INVENTION

The present invention relates generally to a vanity or jewel case, and more particularly to a mirror base fastened pivotally to an upper edge of the vanity or jewel case.

BACKGROUND OF THE INVENTION

As shown in FIG. 1, a vanity or jewel case 80 of the prior art is provided with a mirror base 81 which is fastened pivotally to an upper edge of the case 80 and is provided with a mirror 82 and two mirror doors 83 and 84 each having a mirror 831 or 841. In other words, the mirror base 81 is provided with three mirrors 82, 831 and 841, which are poorly designed such that they undermine the overall esthetic effect of the vanity or jewel case.

SUMMARY OF THE INVENTION

It is therefore the primary objective of the present invention to provide a vanity or jewel case with a mirror base capable of being used as a picture frame.

It is another objective of the present invention to provide a vanity or jewel case with a mirror base capable of giving an added esthetic effect to the vanity or jewel case.

In keeping with the principle of the present invention, the foregoing objectives of the present invention are attained by a mirror base which is fastened pivotally with an upper edge of a case body and is composed of a cover plate and two mirror doors. The cover plate is provided in one side thereof with a mirror, whereas the mirror doors are fastened pivotally with the cover plate and are provided respectively with a mirror opposite in location to the mirror of the cover plate. The mirror doors are provided respectively with a recess for holding a picture, which is further secured by a press plate.

The foregoing objectives, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
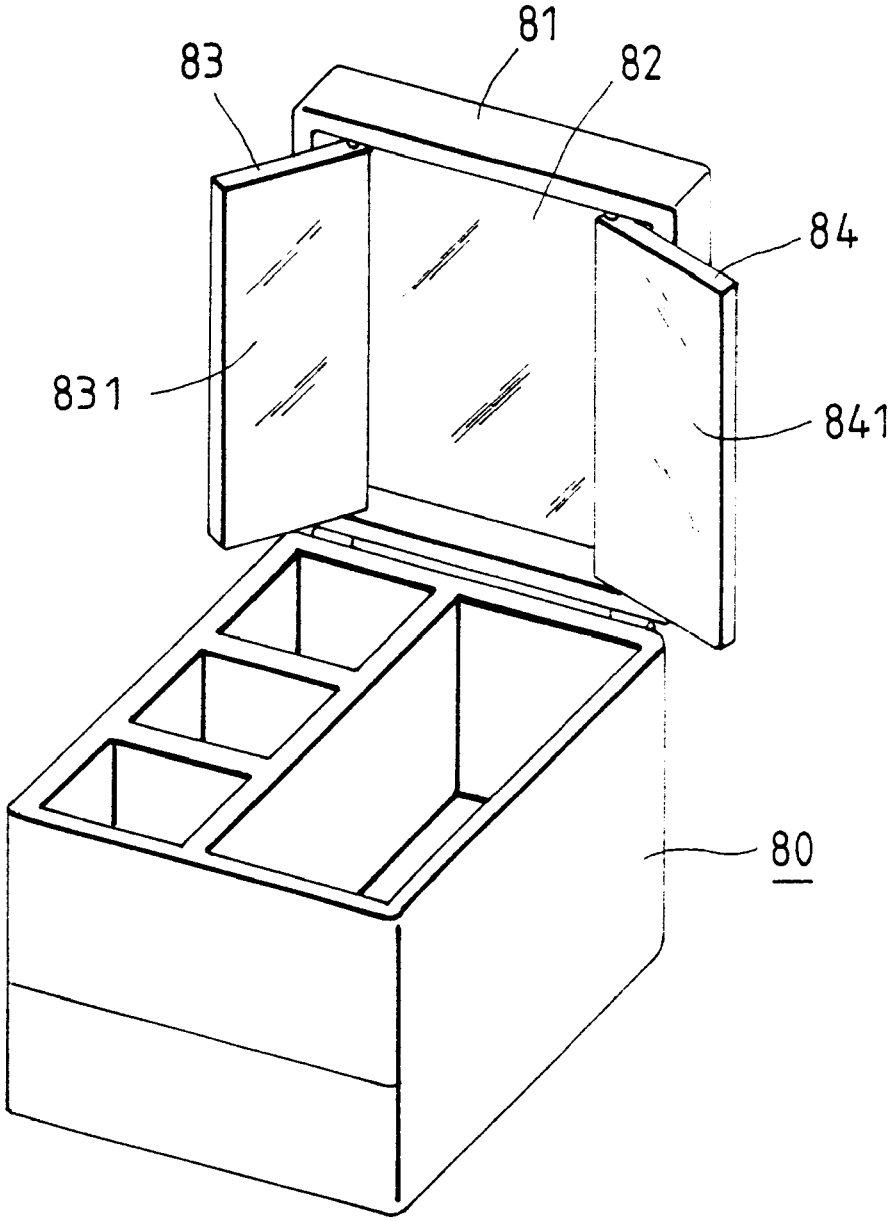
F I G.1 (PRIOR ART)
FIG. 1 shows a schematic view of a vanity or jewel case of the prior art.
Figure 2:
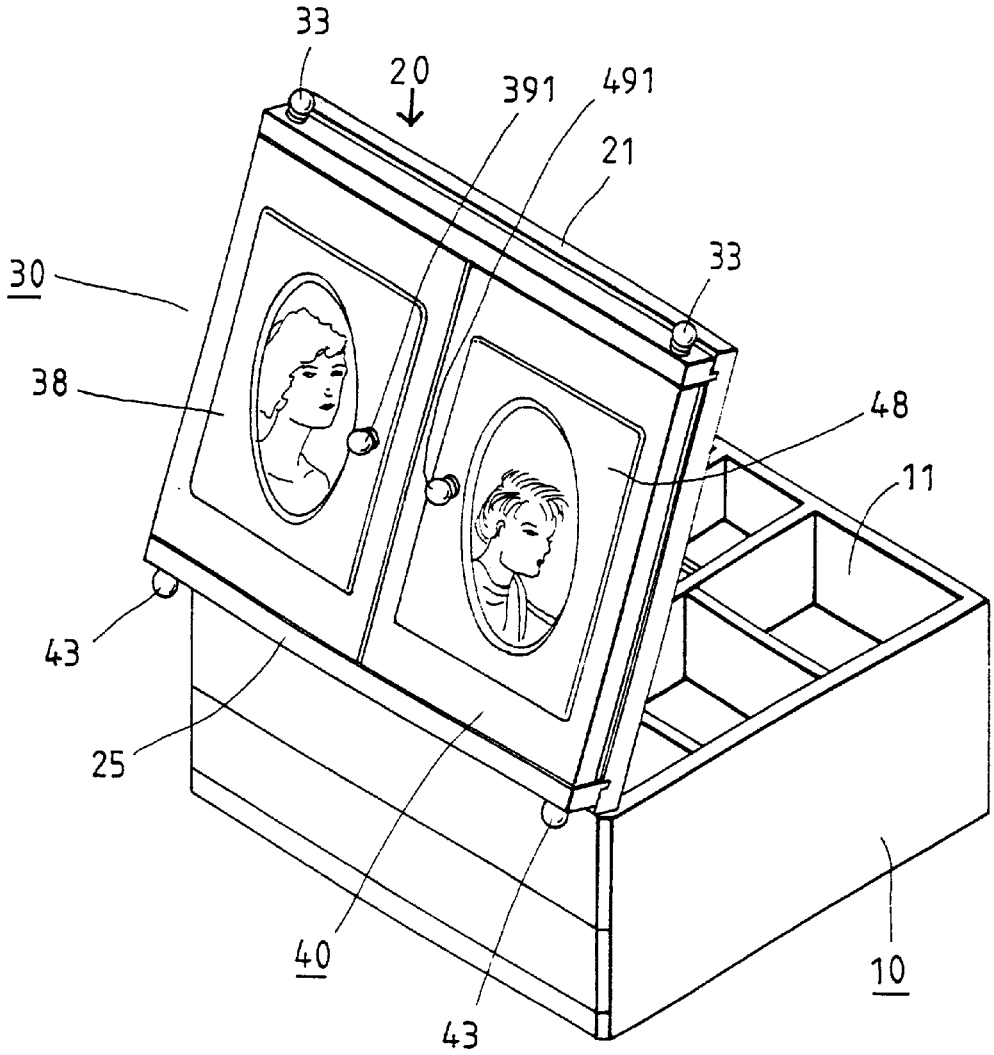
FIG. 2 shows a perspective view of a first preferred embodiment of the present invention.
Figure 3:
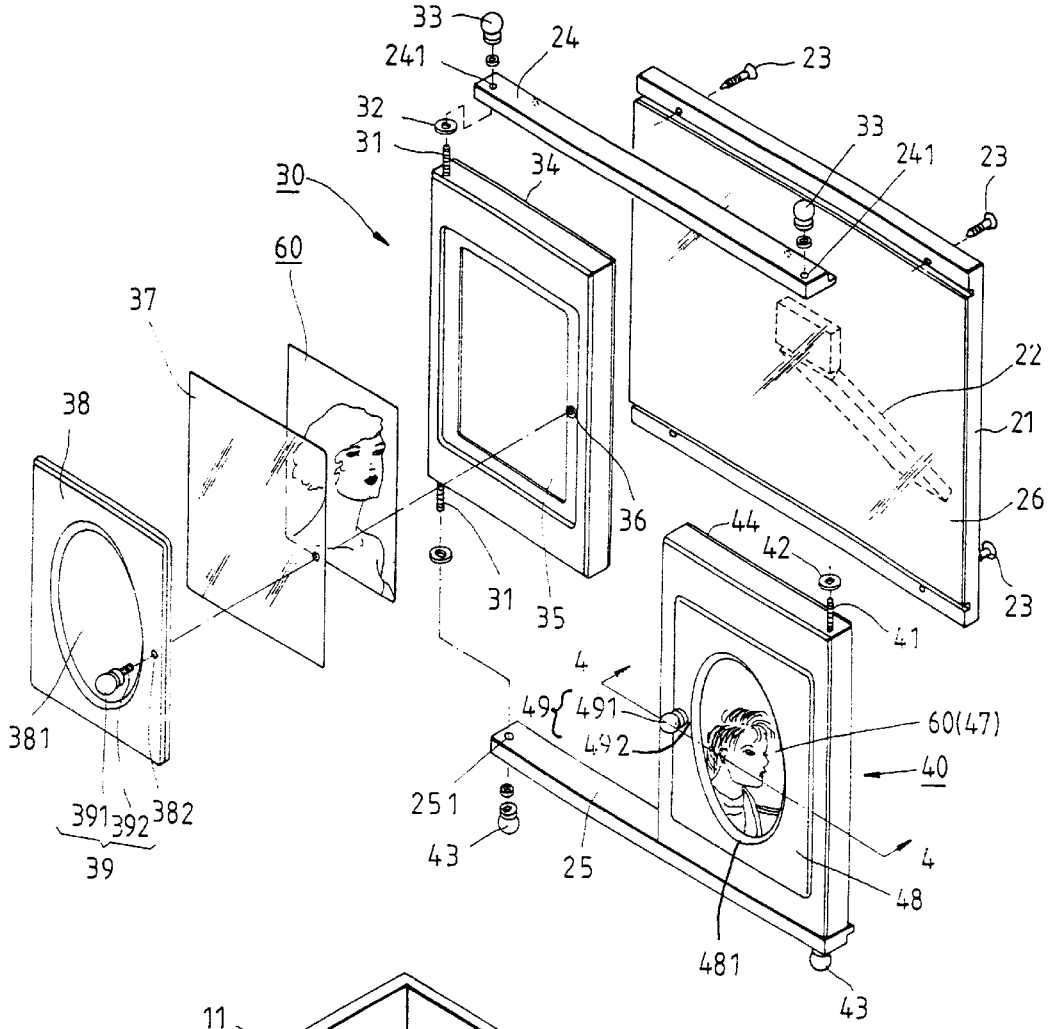
FIG. 3 shows an exploded view of the first preferred embodiment of the present invention.
Figure 3:
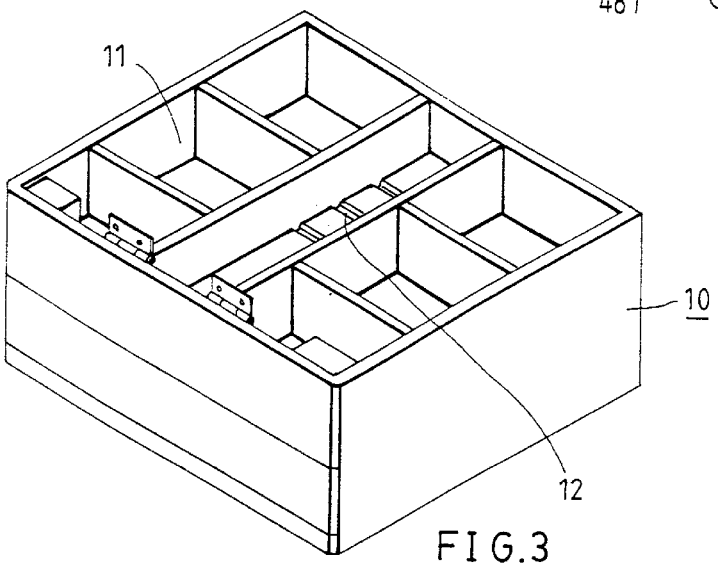
Figure 4:
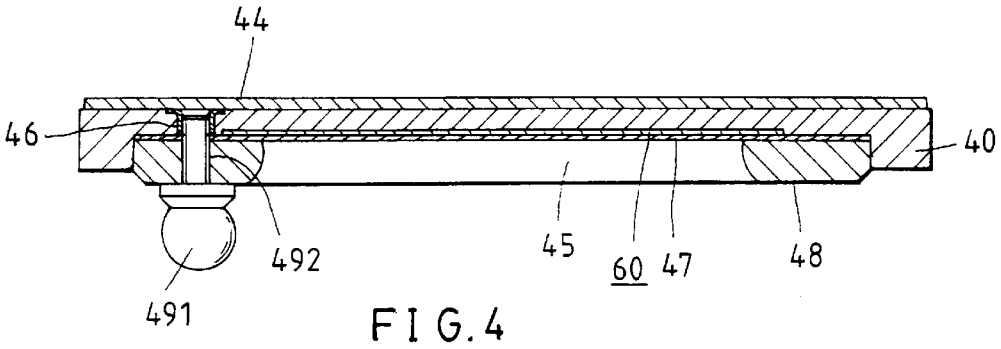
FIG. 4 shows a sectional view of a portion taken along a line 4—4 as shown in FIG. 3.

As shown in FIGS. 2 and 3, a vanity case body 10 of the first preferred embodiment of the present invention is provided with a mirror base 20 fastened pivotally therewith. The body 10 is composed of a plurality of compartments 11 for keeping the cosmetics.

Figure 5:
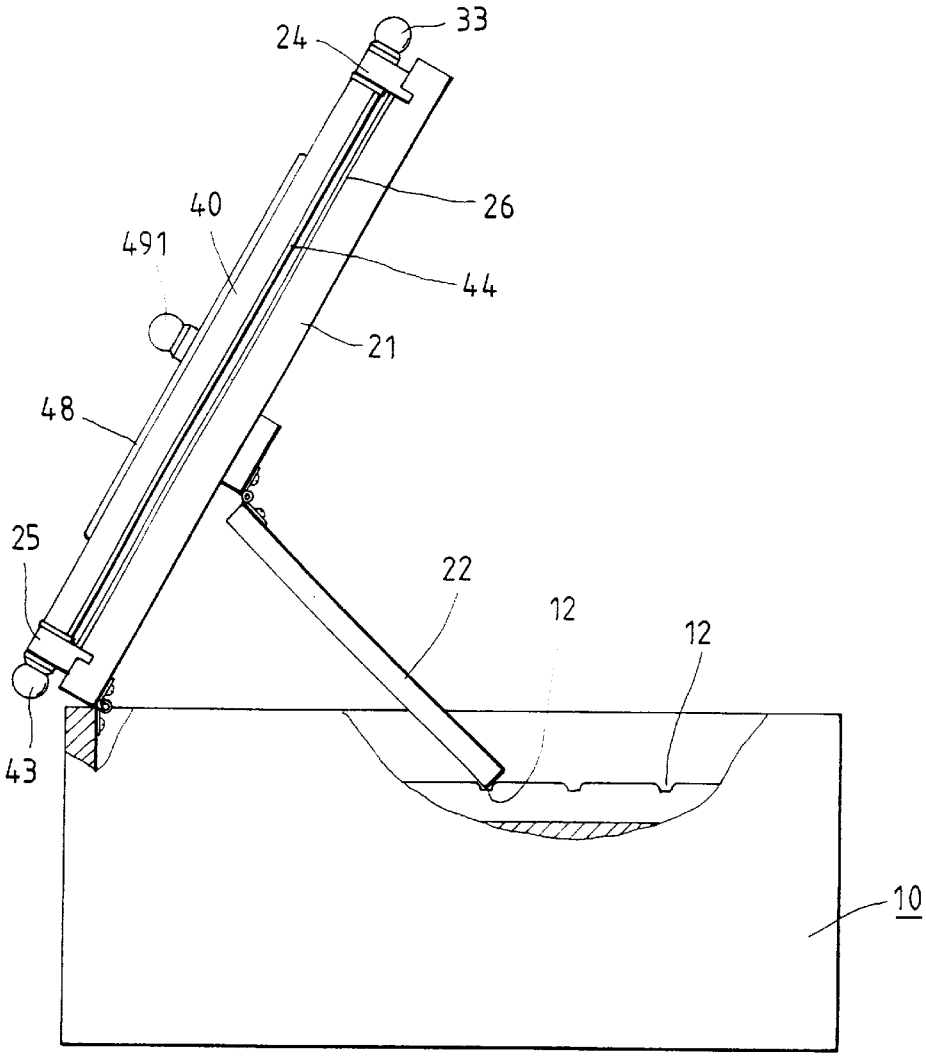
FIG. 5 shows a schematic view of the first preferred embodiment of the present invention at work.

The mirror base 20 comprises a cover plate 21, which is fastened pivotally at one side thereof with an upper edge of one side of the body 10 for covering the compartments 11 of the body 10. The cover plate 21 is provided in the inner side thereof with a bracing frame 22 engageable with a retaining slot 12 of the body 10 when the cover plate 21 is lifted to remain in an inclined position, as shown in FIG. 5. The cover plate 21 is provided at the upper and the lower ends of the outer side thereof with two fastening pieces 24 and 25, which are parallel to each other and fastened with screws 23. Located between the two fastening pieces 24 and 25 is a mirror 26. Two mirror doors 30 and 40 are fastened pivotally with the left and the right sides of the two fastening pieces 24 and 25 and are provided respectively in the outer sides of the top and the bottom sides thereof with an outer threaded portion 31 or 41 passing through a soft cushioning piece 32 or 42 and a through hole 241 or 251 of the fastening piece 24 or 25 to engage a nut 33 or 43. The mirror door 30 or 40 is provided with a mirror 34 or 44 opposite to the mirror 26 of the cover plate 21, and with a square recess 35 or 45 having a threaded hole 36 or 46. Two transparent frame pieces 37 and 47 of a glass or acrylic material are located respectively in the square recess 35 and 45, which are covered by two press plates 38 and 48, which are provided respectively with an oval opening 381 or 481. Two door knobs 39 and 49 of a metal material are provided respectively with a pull end 391 or 491 and an outer threaded portion 392 or 492, which is engaged with the threaded hole 36 or 46 via round holes, for example 382, of the press plate 38 or 48.

In locating a picture 60, the door knobs 39 and 49 are first removed to release the press plates 38 and 48 of the pressure of the door knobs 39 and 49, so as to remove the press plates 38 and 48, and the transparent frame pieces 37 and 47. The picture 60 is then placed in the square recesses 35 or 45 of the two mirror doors 30 and 40. The transparent frame pieces 37 or 47 and the press plate 38 or 48 are then put back and fastened securely. The mirror can be put to use by lifting the mirror base 20 to locate at an inclined position. The mirrors 26, 34 and 44 can be then exposed for use.

The present invention is unique in design in that the mirror doors 30 and 40 are provided respectively with a recess 35 or 45 for holding the picture 60, and that the door knobs 39 and 49 serve as fastening elements for fastening the press plates 38 and 48 with the mirror doors 30 and 40.

Figure 6:
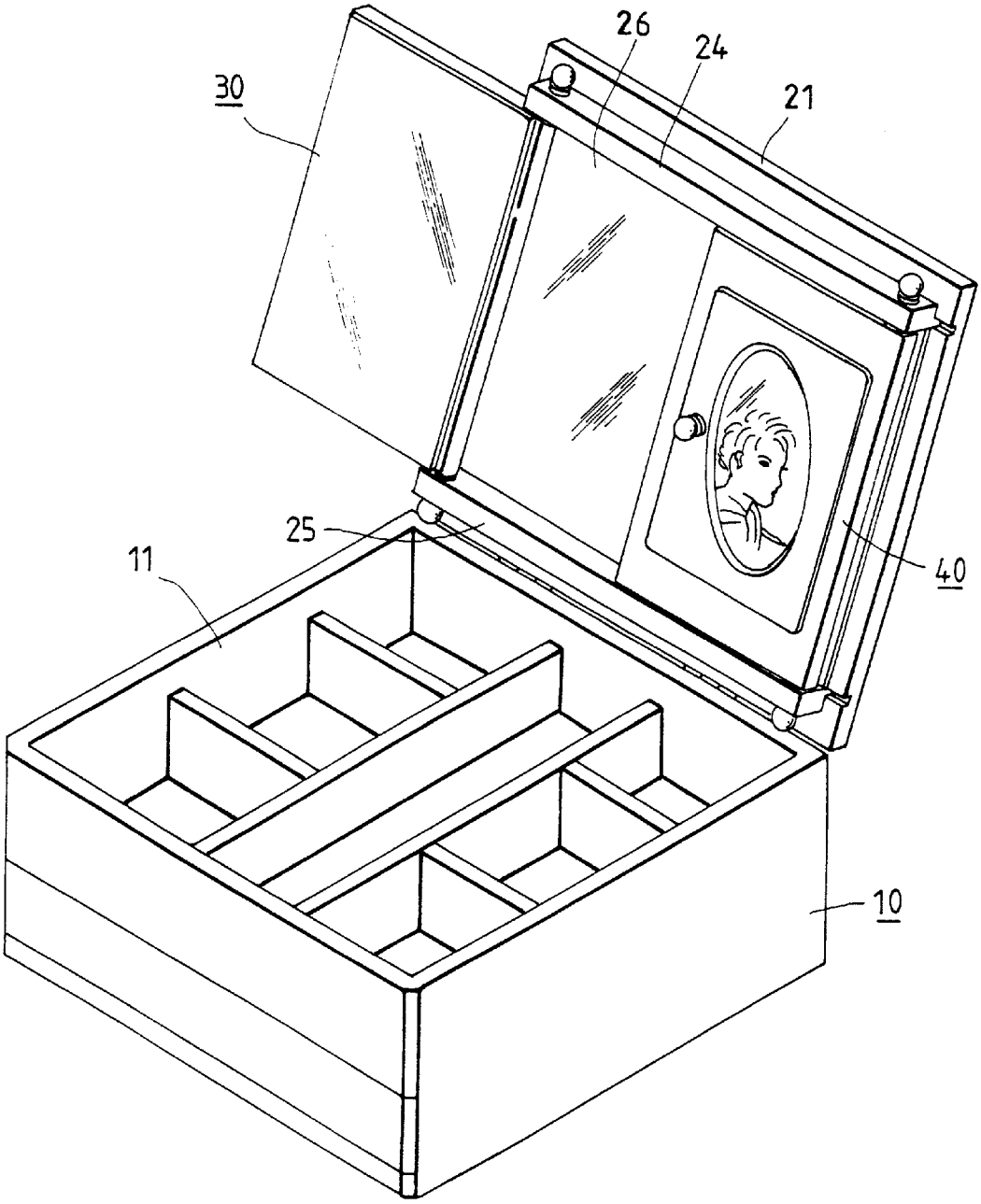
FIG. 6 shows a schematic view of a second preferred embodiment of the present invention.

As shown in FIG. 6, the second preferred embodiment of the present invention is provided with the mirrors, which are concealed in the body 10 when the mirror doors 30 and 40 are not in use. When the mirror base 20 is located at a position in excess of 90 degrees, the present invention can be used as a mirror at such time when the mirror doors 30 and 40 are opened.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A mirror base for a vanity case, said mirror base adapted to be fastened pivotally with an upper edge of one side of a body of said vanity case, said mirror base composed of a cover plate provided on one side thereof with a mirror fastened therewith, said mirror base further composed of two mirror doors fastened pivotally with said cover plate and provided respectively with a mirror opposite to said mirror of said cover plate; wherein each of said two mirror doors is provided respectively with a recess for locating a picture and a press plate having an opening for revealing the picture;

wherein said press plate and said recess of each of said mirror doors is provided therebetween with a transparent frame piece corresponding in shape to said press plate and said recess;

wherein each of said mirror doors is provided respectively on an outer side thereof with a door knob;

wherein each said door knob is provided at one end thereof with a pull end, and at another end thereof with an outer threaded portion, each said outer threaded portion engaged through a round hole in a respective, said press plate to a threaded hole in a respective said mirror door, each said threaded hole being located adjacent to a respective said opening.

2. The mirror base as defined in claim 1, wherein said opening in each said press plate is oval in shape.

3. The mirror base as defined in claim 1, wherein said mirror of said cover plate, is adapted to face an interior of said body of said vanity case.

4. The mirror base as defined in claim 1, wherein said cover plate is provided with a bracing frame adapted to be engageable with a retaining slot of said body of said vanity case when said cover plate is at an open position.

* * * * *